US009462361B2

(12) United States Patent
Amae et al.

(10) Patent No.: US 9,462,361 B2
(45) Date of Patent: Oct. 4, 2016

(54) SEALED AUDIO SPEAKER DESIGN

(71) Applicant: Logitech Europe S.A, Lausanne (CH)

(72) Inventors: Dominic Amae, Camas, WA (US); Zachary M. Etter, Vancouver, WA (US)

(73) Assignee: LOGITECH EUROPE S.A., Lausanne (CH)

( * ) Notice: Subject to any disclaimer, the term of this patent is extended or adjusted under 35 U.S.C. 154(b) by 0 days.

(21) Appl. No.: 14/681,009

(22) Filed: Apr. 7, 2015

(65) Prior Publication Data

US 2015/0334481 A1 Nov. 19, 2015

Related U.S. Application Data

(60) Provisional application No. 62/000,453, filed on May 19, 2014.

(51) Int. Cl.

| | |
|---|---|
| ***H04R 1/02*** | (2006.01) |
| ***H04R 31/00*** | (2006.01) |
| *H04R 1/28* | (2006.01) |

(52) U.S. Cl.

CPC ..... *H04R 1/02* (2013.01); *H04R 31/00* (2013.01); *H04R 31/006* (2013.01); *H04R 1/2834* (2013.01); *H04R 2201/028* (2013.01); *H04R 2201/029* (2013.01); *Y10T 29/49007* (2015.01)

(58) Field of Classification Search

CPC ..... H04R 1/02; H04R 1/025; H04R 1/2869; H04R 1/2873; H04R 1/2876; H04R 1/288; H04R 1/2884; H04R 1/2888; H04R 1/2892; H04R 1/2896; H04R 31/00; H04R 31/006; H04R 2201/02; H04R 2499/11

See application file for complete search history.

(56) References Cited

U.S. PATENT DOCUMENTS 1,717,801 A * 6/1929 Metcalf ..... A45C 1/06 206/39
2,880,761 A * 4/1959 Peter ..... B65D 59/00 138/96 T
3,161,160 A * 12/1964 Wilson ..... A47B 57/045 108/6
3,931,663 A * 1/1976 Holmes ..... E05D 5/046 16/321
3,982,779 A * 9/1976 Hickey ..... F16L 21/06 285/148.27
4,422,504 A * 12/1983 Moore ..... F16L 35/00 166/241.7
4,450,495 A * 5/1984 Naruki ..... G11B 25/063 224/674
4,484,785 A * 11/1984 Jackson ..... E21B 17/1035 138/110
4,580,654 A * 4/1986 Hale ..... H04R 1/323 181/146

(Continued)

*Primary Examiner* — Curtis Kuntz
*Assistant Examiner* — Joshua Kaufman
(74) *Attorney, Agent, or Firm* — Patterson & Sheridan, LLP

(57) ABSTRACT

An audio speaker is provided including a housing having a first array of housing retaining elements aligned in a first direction and a first sealing surface. Each housing retaining elements has a housing channel region formed therein. The audio speaker further includes a frame element having a speaker assembly mounted thereon and a second array of frame retaining elements aligned in the first direction and a second sealing surface, where the second array of frame retaining elements are positioned to interleave with the first array of housing retaining elements when the second sealing surface is disposed over the first sealing surface. Each frame retaining element has a frame channel region formed therein. The audio speaker further includes a first rod disposed within the housing channel regions of the first array of housing retaining elements and the frame channel regions of the second array of frame retaining elements.

19 Claims, 7 Drawing Sheets

(56) References Cited

U.S. PATENT DOCUMENTS 4,615,543 A * 10/1986 Cannon ..... F16L 35/00 166/241.4
4,862,429 A * 8/1989 Rolt ..... G10K 9/121 367/158
4,915,424 A * 4/1990 Sarno ..... F16L 41/021 285/133.21
4,932,008 A * 6/1990 Rolt ..... G10K 9/121 367/158
5,127,132 A * 7/1992 Karlin ..... E05D 7/1044 16/261
5,191,177 A * 3/1993 Chi ..... B60R 11/0217 181/153
5,286,928 A * 2/1994 Borland ..... H04R 1/2819 181/153
5,357,565 A * 10/1994 Butler, III ..... E05D 11/0054 16/250
5,652,413 A * 7/1997 Mulera ..... H04R 1/023 181/141
6,336,249 B1 * 1/2002 Plumley ..... E05D 5/04 16/225
6,484,843 B2 * 11/2002 Yoshii ..... H04R 1/345 181/153
6,859,543 B2 * 2/2005 Fingleton ..... H04R 1/323 181/153
7,307,217 B2 * 12/2007 Daito ..... H02G 3/0418 138/157
7,605,862 B2 * 10/2009 Hou ..... H04R 1/2803 348/373
7,819,456 B2 * 10/2010 Robertson ..... B62D 25/24 280/728.3
8,181,999 B2 * 5/2012 Cromarty ..... F16L 25/0018 285/419
9,012,774 B2 * 4/2015 Simmons ..... H01R 9/223 174/50.5
2004/0101152 A1 * 5/2004 Fingleton ..... H04R 1/323 381/336
2004/0108289 A1 * 6/2004 Chen ..... A47B 96/06 211/183
2006/0274493 A1 * 12/2006 Richardson ..... G06F 1/1626 361/679.4
2009/0268934 A1 * 10/2009 Martikainen ..... H04R 1/2819 381/349
2010/0314870 A1 * 12/2010 Cromarty ..... F16L 25/0018 285/420
2015/0334481 A1 * 11/2015 Amae ..... H04R 1/02 381/386

* cited by examiner

SEALED AUDIO SPEAKER DESIGN

CROSS REFERENCE TO RELATED APPLICATIONS

This application claims benefit of U.S. provisional patent application Ser. No. 62/000,453, filed May 19, 2014, which is hereby incorporated herein by reference.

BACKGROUND

1. Field

Embodiments of the present disclosure generally relate to an audio device and, more specifically, to an apparatus and method of forming a sealed audio speaker assembly.

2. Description of the Related Art

An important goal in audio speaker, or simply "speaker," design has been sound quality. With the advent of mobile media players, such as smart phones, iPods®, and other devices, there has been an effort to develop small audio speakers, and in particular wireless speakers that receive a stream of digital information that is translated into sound via one or more speakers.

Typically, audio speakers include an enclosure and at least one sound transducer, or active driver speaker, having a diaphragm that produces sound waves by converting an electrical signal into mechanical motion of the driver diaphragm. Sound transducers, such as active driver speakers, typically generate sound waves by physically moving air at various frequencies. That is, an active driver speaker pushes and pulls a diaphragm in order to create periodic increases and decreases in air pressure, thus creating sound.

To improve sound quality in an audio speaker it is sometimes desirable to use a passive device called a "passive radiator," or "passive diaphragm." Like active driver speakers, passive radiators typically include a sound radiating surface, or diaphragm, attached via a suspension mechanism to a support structure and/or wall of the speaker enclosure. The radiator surface and suspension mechanism are typically tuned by their mass, flexibility/compliance, and surface area to move in response to compression and rarefaction of air inside the enclosure, which results from the movement of the active driver speaker(s). Movement of the radiator surface causes movement of air outside the enclosure, which causes sound to be generated at the movement frequency. Therefore, to create an audio speaker that has good sound quality it is desirable to form a speaker enclosure that is sealed to allow the active and passive components in the audio speaker to perform in a desired manner. Forming a sealed speaker will also have an improved sound generation efficiency over an unsealed or partially sealed speaker design. In other words, the better the speaker is sealed, the less energy that will be expended by the active components in the speaker to achieve the same acoustic pressure during use. Therefore, a sealed speaker design will improve a battery powered speaker's battery life and allow more compact speaker designs to be formed. Also, forming a sealed speaker design that is water tight or water proof, will improve the lifetime of these types of consumer products over conventional designs, which is a competitive advantage.

However, audio speaker designs with a sealed enclosure are often hard to reliably manufacture and can lead to a large amount of scrap and/or manufacturing cost when parts that are sealed against the enclosure need to be removed and/or reworked during the manufacturing process. Conventional designs have typically used many fasteners, such as screws, and seals (e.g., gaskets) to retain and form a seal between the active and passive components and the speaker enclosure. While the piece part cost for an assembly that contains many fasteners is undesirably high, the use of the many fasteners to retain the active and passive components also creates other problems. For example, it has been found that the use of fasteners can lead to sealing problems due to the differing torque that can be applied to the fasteners during the manufacturing of the audio speaker. Also, due to the relaxation of the material in the component and enclosure parts around the screw threads, the fasteners can become loose, resulting in lower seal compression force over time. This often leads to re-tightening and/or resetting of the various audio speaker components and scrap. Additionally, this unwanted material creep effect may cause leaking that is not detectable at the time of manufacture, so an audio speaker that passed the leak test at the end of the assembly line can become defective during storage and shipping. All of these issues generally lead to a higher than desired manufacturing cost, reduced speaker efficiency, shorter useable lifetime and a large number of scrapped components.

Therefore, there is need for an enclosed and sealed audio speaker design that provides a high-quality sound output and is easily manufactured and reworked during the manufacturing process. The devices, systems, and methods disclosed herein are designed to overcome these deficiencies.

SUMMARY

Embodiments disclosed herein generally relate to an audio speaker design and a method of manufacturing an audio speaker. In one embodiment, an audio speaker is provided. The audio speaker includes a housing having a first array of housing retaining elements aligned in a first direction and a first sealing surface. Each housing retaining elements has a housing channel region formed therein. The audio speaker further includes a frame element having a speaker assembly mounted thereon and a second array of frame retaining elements aligned in the first direction and a second sealing surface, where the second array of frame retaining elements are positioned to interleave with the first array of housing retaining elements when the second sealing surface is disposed over the first sealing surface. Each frame retaining element has a frame channel region formed therein. The audio speaker further includes a first rod disposed within the housing channel regions of the first array of housing retaining elements and the frame channel regions of the second array of frame retaining elements.

In another embodiment, an audio speaker is provided. The audio speaker includes a housing having a first array of housing retaining elements aligned in a first direction, an internal region and a first sealing surface, wherein each of the housing retaining elements have a housing channel region formed therein. The audio speaker further includes a first frame element having a first array of frame retaining elements aligned in the first direction and a second sealing surface, wherein the first array of frame retaining elements are positioned to interleave with the first array of housing retaining elements when the second sealing surface is disposed over the first sealing surface, and each of the frame retaining elements have a frame channel region formed therein. The audio speaker further includes a first rod disposed within the housing channel regions of the first array of housing retaining elements and the frame channel regions of the first array of frame retaining elements. The audio speaker further includes an electronic assembly disposed in the internal region of the housing. The electronic assembly includes a processor, a battery configured to deliver power to the processor, and a wireless transceiver that is configured to communicate with the processor, and an active speaker assembly mounted on the first frame element.

In another embodiment, a method of manufacturing an audio speaker is provided. The method includes positioning a first sealing surface of a first frame element over a second sealing surface of a housing, wherein the first frame element includes an array of frame retaining elements that is aligned in a first direction and the housing includes a first array of housing retaining elements that is aligned in the first direction. The method further includes inserting a first rod into a first channel region formed in the housing retaining elements and a second channel region formed in the frame retaining elements, wherein the first and second channel regions are aligned in the first direction. An equal and opposite sealing force is formed on the first sealing surface and the second sealing surface when the first rod is disposed within the first and second channel regions.

In another embodiment, an audio speaker may include a housing having a first array of housing retaining elements aligned in a first direction and a first sealing surface facing a second direction. The audio speaker further includes a frame element having a second array of frame retaining elements aligned in the first direction and interleaved with the first array of housing retaining elements in the first direction, the frame element having a second sealing surface facing the first sealing surface in a third direction. The audio speaker further includes a first rod disposed between the first array of housing retaining elements and the second array of frame retaining elements, the first rod having a first axis in the first direction, a first region on a first side of the first axis, and a second region on a second side of the first axis. A direction from the first region to the second region is the second direction. Each housing retaining element is disposed at least partially around portions of the second region and each frame retaining element is disposed at least partially around portions of the first region. A speaker assembly mounted on the frame element.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of its scope, and may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

The present disclosure generally provides an apparatus and method of forming an enclosed and sealed audio speaker that provides a high-quality sound output and is easily manufactured and reworked during the manufacturing process.

Figure 1:
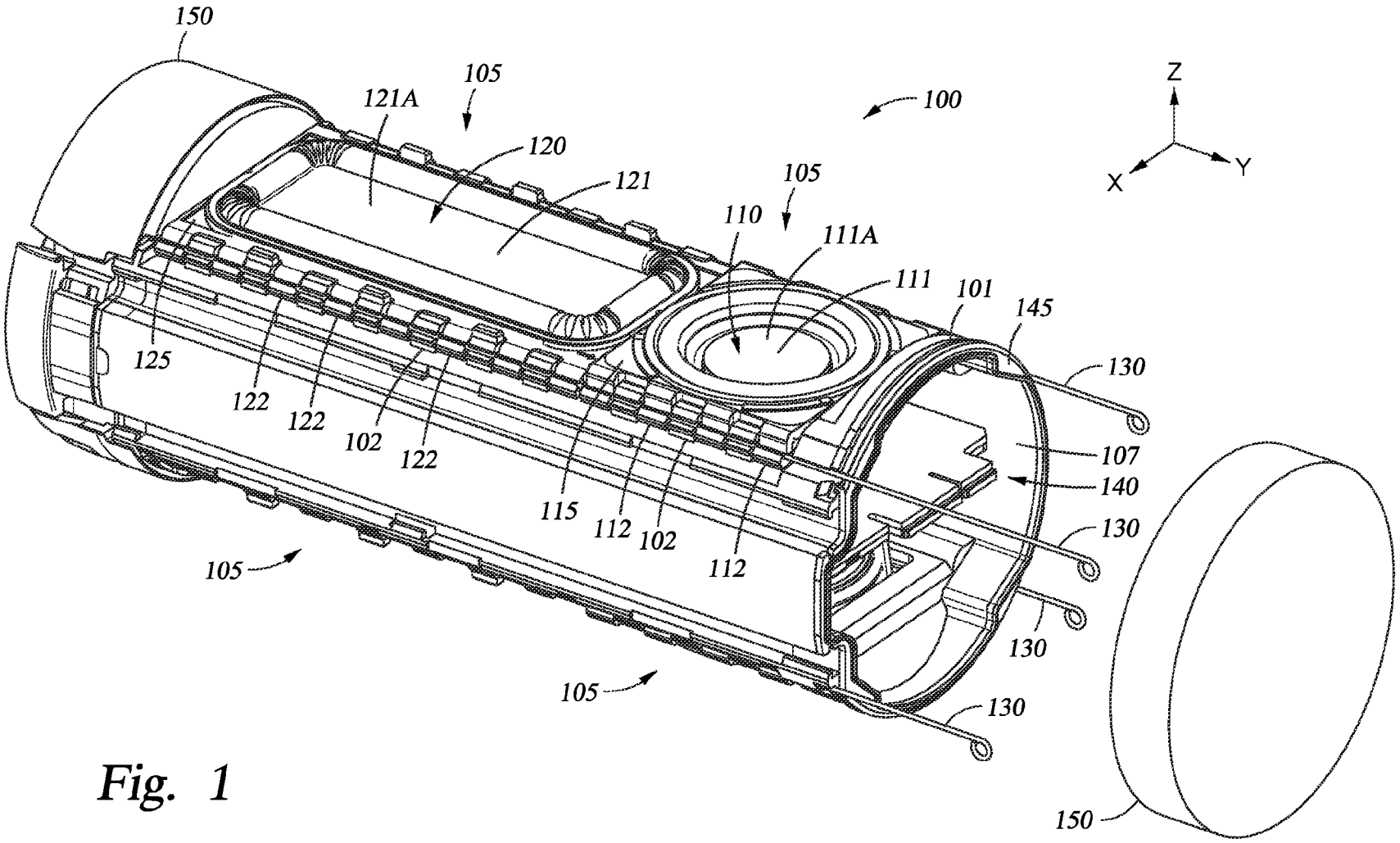
FIG. 1 is an isometric partial exploded view of an audio speaker, according to an embodiment of the disclosure provided herein.

FIG. 1 is an isometric partially exploded view of an audio speaker 100, according to an embodiment of the disclosure provided herein. In general, the audio speaker 100 includes a housing 101, electronic components 140, one or more end caps 150 and one or more speaker assemblies 105. Each of the one or more end caps 150 can be retained against a sealing surface 145 at respective ends of the housing 101 in the Y-direction by use of mating mechanical clasping features formed in the housing 101 and end cap 150 and/or use of an adhesive material that causes a seal to be formed between the end cap 150 and the housing 101. The sealing surface 145 may include for example, a gasket (e.g., elastomeric seal). The sealing surface 145 together with additional seals discussed below allow the interior of the housing 101 to be sealed from the external environment.

The one or more speaker assemblies 105 can be retained against a surface of the housing 101 by use of two or more removable rods 130 (also referred to as a first rod and a second rod). The electronic components 140, which include the electronics used to drive the speaker components and communicate with an external host device, are positioned within an internal region 107 of the housing 101. The internal region 107 is sealed from the external environment outside of the audio speaker 100 when assembly of the audio speaker 100 is complete. In general, the internal region 107 is sealed when one or more seals are formed between the end caps 150 and the housing 101 as well as one or more seals are formed between the one or more speaker assemblies 105 and the housing 101.

In general, the electronic components 140, or also referred to herein as the electronic assembly, may include various electronic components, such as integrated circuits, printed circuit boards, electrical circuit elements (resistors, capacitors, etc.), connectors, wiring harnesses and other useful electronic devices, which are used to communicate with other electronic devices and deliver an audio output to a user. The electronic components 140 may include, for example, a wireless receiver or transceiver (e.g., Wi-Fi or Bluetooth® transceiver) for communicating with the external host device, such as a computer or mobile phone. The electronic components 140 may further include one or more processors and one or more memory units. In some configurations, the processor can include a central processing unit (CPU), a digital signal processor (DSP), an application-specific integrated circuit (ASIC), and/or a combination of such units. The processor is generally configured to execute one or more software applications and use process media data that is stored within one of the memory units to deliver an audio output to a user. The electronic components 140 further include a speaker driver that is used to drive the voice coil components in the active speaker components 111 within the audio speaker 100 during operation. The electronic components 140 may further include one or more power sources (e.g., batteries) along with associated circuits for recharging. The electronic components 140 may further include wiring connecting various devices, such as the speaker assemblies 105, processor, memory, switches (e.g., an externally accessible power switch), audio jack (e.g., for an optional wired input connection) sensors, user interface buttons and LEDs.

A speaker assembly 105 may comprise an active speaker assembly 110 and/or a passive element assembly 120. In one example, as illustrated in FIG. 1, the audio speaker 100 includes four speaker assemblies 105, such as two active speaker assemblies 110 and two passive element assemblies 120, wherein both of the active speaker assemblies 110 and the passive element assemblies 120 are mounted on opposing sides of the housing 101.

The housing 101 may include a plurality of housing retaining elements 102. The plurality of housing retaining elements 102 may be used along with one of the rods 130 to secure various components to the housing 101, such as a speaker assembly 105. An active speaker assembly 110 may include an active speaker component 111 that is mounted on and sealed to a frame element 115. The active speaker component 111 may include a diaphragm 111A, a voice coil (not shown), a magnet assembly (not shown) and other supporting components. The frame element 115 includes a plurality of frame retaining elements 112. When the frame retaining element(s) 112 are engaged with a removable rod 130, which is also engaged with one or more housing retaining elements 102 of the housing 101, a force is created between the housing 101 and the frame element 115 of the active speaker assembly 110 to form a seal therebetween.

The passive element assembly 120 may include a passive element 121 that is mounted on and sealed to a frame element 125. The passive element 121 may include a diaphragm 121A and other supporting components. The frame element 125 includes a plurality of frame retaining elements 122. When the frame retaining element(s) 122 are engaged with a removable rod 130, which is also engaged with one or more housing retaining elements 102 of the housing 101, a force is created between the housing 101 and the frame element 125 of the passive element assembly 120 to form a seal therebetween.

During the manufacturing process, each speaker assembly 105, such as the active speaker assemblies 110 and passive element assemblies 120, are formed separately, so that they can each be mounted on and sealed to the housing 101 when the removable rods 130 are engaged with the frame retaining elements (e.g., frame retaining elements 112 and/or 122) of the speaker assemblies 105 and the plurality of housing retaining elements 102. As illustrated in FIG. 1, the removable rods 130 are only partially inserted into the interleaving arrays of frame retaining elements 112, 122 and housing retaining elements 102. Further details on the arrays of frame retaining elements are discussed in reference to FIGS. 3A-3B.

Figure 2:
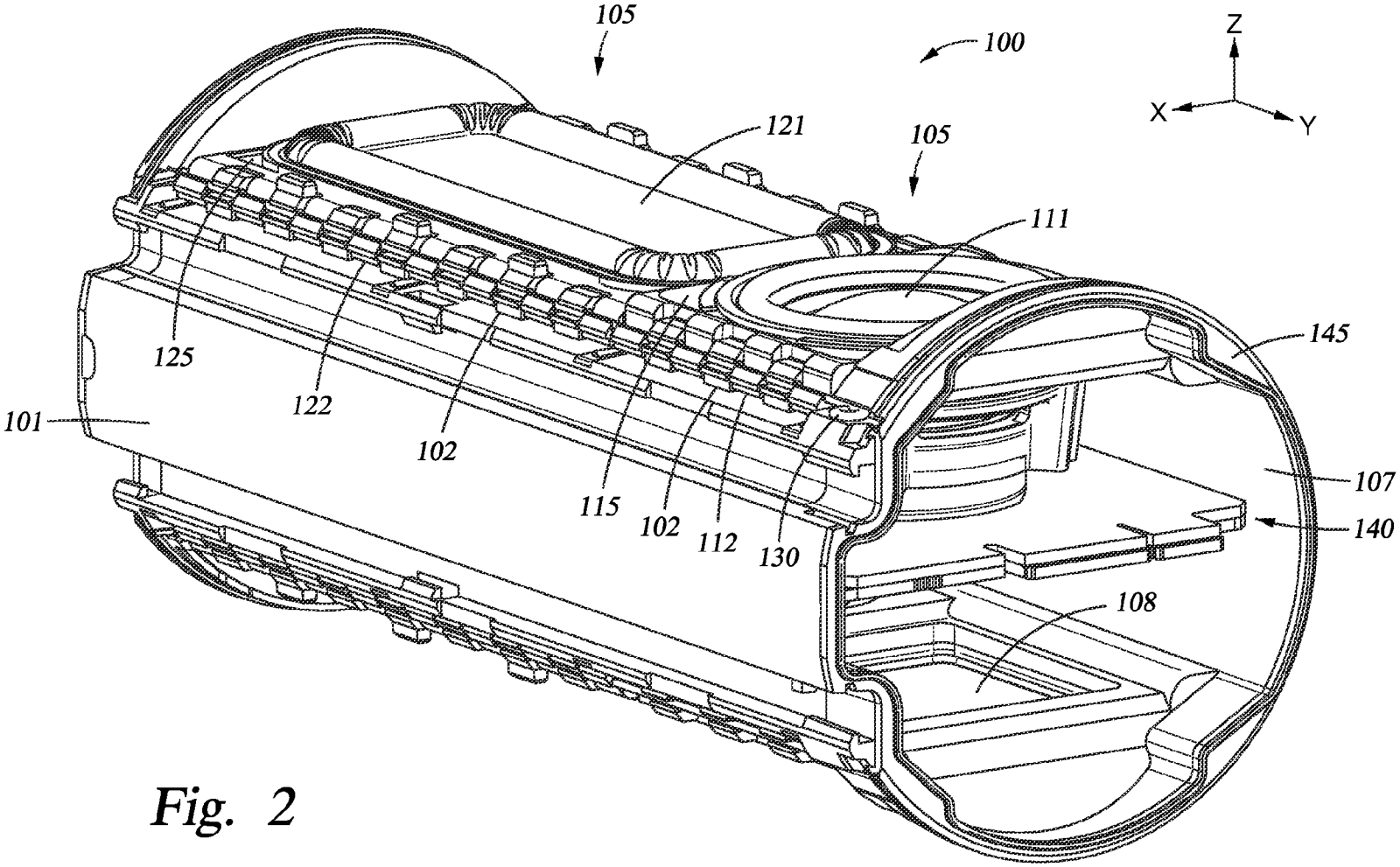
FIG. 2 is an isometric view of a partially assembled audio speaker, according to an embodiment of the disclosure provided herein.

FIG. 2 is an isometric view of a partially assembled audio speaker 100 that includes two speaker assemblies 105 that are mounted and sealed to the housing 101 by two fully inserted removable rods 130. Only one removable rod 130 is shown in FIG. 2 since the second removable rod 130 is positioned on an opposing side of the frame elements 115 and 125, and thus is obscured by part of the housing 101. When the removable rods 130 on both sides of the frame elements 115, 125 are fully inserted, the frame elements 115, 125 can be secured to the housing 101. As shown in FIG. 2, the housing retaining elements 102 have a portion above and below the removable rod 130. On the other hand, the frame retaining elements 112, 122 have portions below the removable rod 130, but not above the removable rod 130. Thus as shown in FIG. 2, the removable rod 130 can apply a downward pressure to the frame retaining elements 112, 122 and an upward pressure on the housing retaining elements 102 resulting in compression between the frame elements 115, 125 and the housing 101. This compression enables an airtight seal to be created between the frame elements 115, 125 and the housing 101.

Figure 3A:
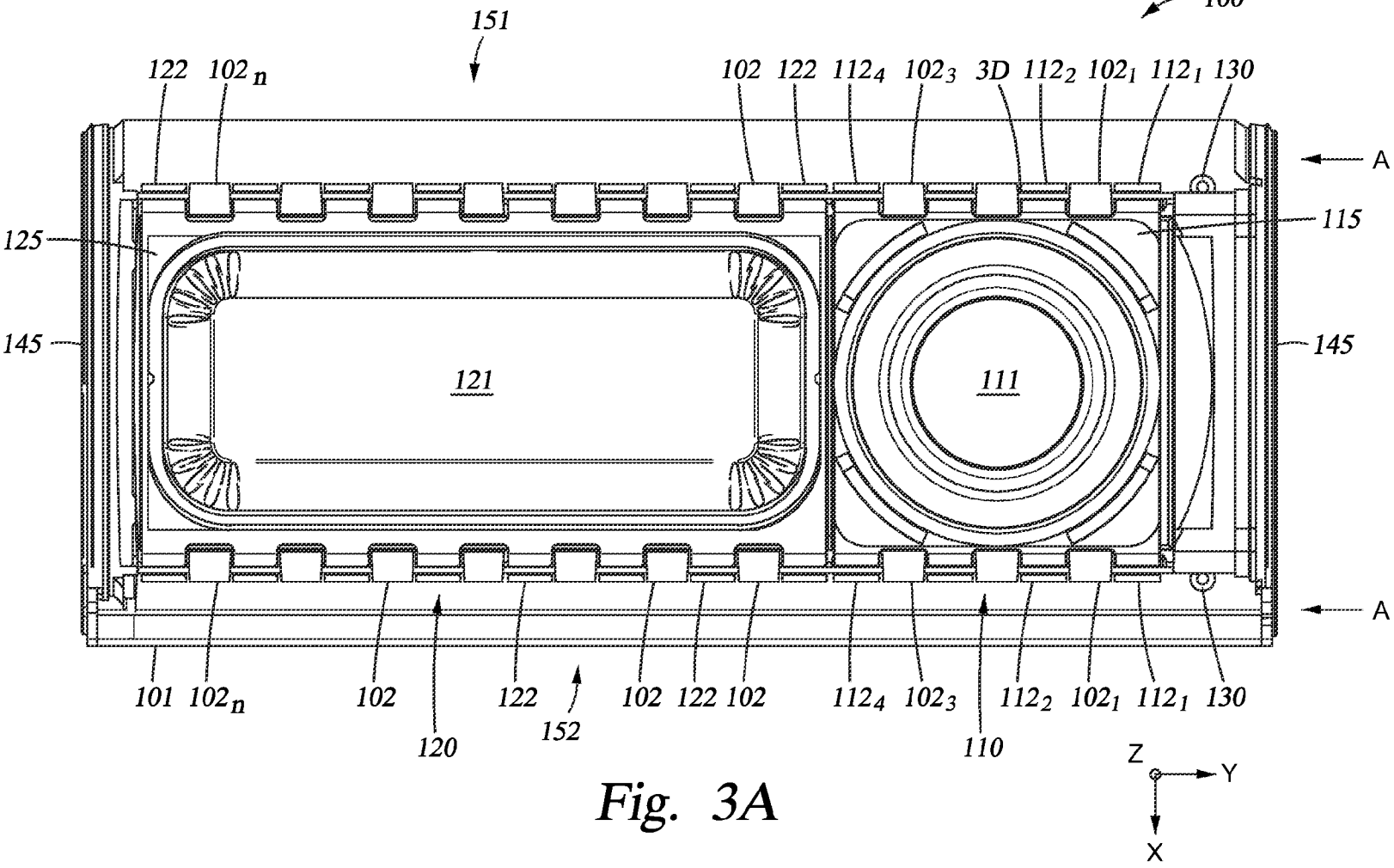
FIG. 3A is a plan view of a partially assembled audio speaker, according to an embodiment of the disclosure provided herein.

FIG. 3A is a plan view of a partially assembled audio speaker 100 that includes two speaker assemblies 105 that are mounted on and sealed to the housing 101 by two fully inserted removable rods 130 that are positioned on first and second sides 151, 152 of the frame elements 115, 125 (i.e., sides spaced apart in the X-direction). One will note that the end caps 150 have been removed for clarity of the illustration shown in FIG. 3A. The housing 101 has a first array of housing retaining elements 102 aligned in a first direction "A" on the first side 151 of the audio speaker 100. The first array of housing retaining elements 102 can include housing retaining elements $\mathbf{102}_1$-$\mathbf{102}_3$. In an embodiment in which one frame element included both the active speaker assembly 110 and the passive element assembly 120, then the first array of housing retaining elements 102 can include housing retaining elements $\mathbf{102}_1$-$\mathbf{102}_n$. The frame element 115 has a second array of frame retaining elements 112 aligned in the first direction A and interleaved with the first array of housing retaining elements 102 in the first direction "A" on the first side 151 of the audio speaker 100. The second array of frame retaining elements 112 can include frame retaining elements $\mathbf{112}_1$-$\mathbf{112}_4$ that are disposed on the first side 151 of the audio speaker 100. In some embodiments, the first array of housing retaining elements 102 includes at least three housing retaining elements 102. Furthermore, in some embodiments the second array of frame retaining elements 112 includes at least three frame retaining elements 112.

The housing 101 can further include a third array of housing retaining elements 102 attached to the housing 101 and aligned in the first direction A on the second side 152 of the audio speaker 100. The frame element 115 can further include a fourth array of frame retaining elements 112 attached to the frame element 115 and interleaved with the third array of housing retaining elements 102 in the first direction A on the second side 152 of the audio speaker 100. The third and fourth arrays are identified by the same reference numbers on the second side 152 as the reference numbers used to identify the first and second arrays respectively on the first side 151 of the audio speaker 100. A second removable rod 130 may be disposed between the third array of housing retaining elements 102 and the fourth array of frame retaining elements 112. The second removable rod 130 may be the same as the removable rod 130. The first and second removable rods 130 may be inserted between housing retaining elements and frame retaining elements along substantially in entire length of the audio speaker to secure more than one frame element, such as frame elements 115, 125, to the housing.

Therefore, in some configurations, the frame elements 115, 125 each have an array of frame retaining elements on at least two sides of the frame elements 115, 125 that interleave with housing retaining elements 102 that are also formed on the at least two sides of the housing 101. In one example, as shown in FIG. 3A, the frame element 115 includes an array of frame retaining elements $\mathbf{112}_1$-$\mathbf{112}_4$ on the first side 151 and an array of frame retaining elements $\mathbf{112}_1$-$\mathbf{112}_4$ on the second side 152 that interleave with housing retaining elements 102 that are formed on the sides 151 and 152.

Figure 3B:
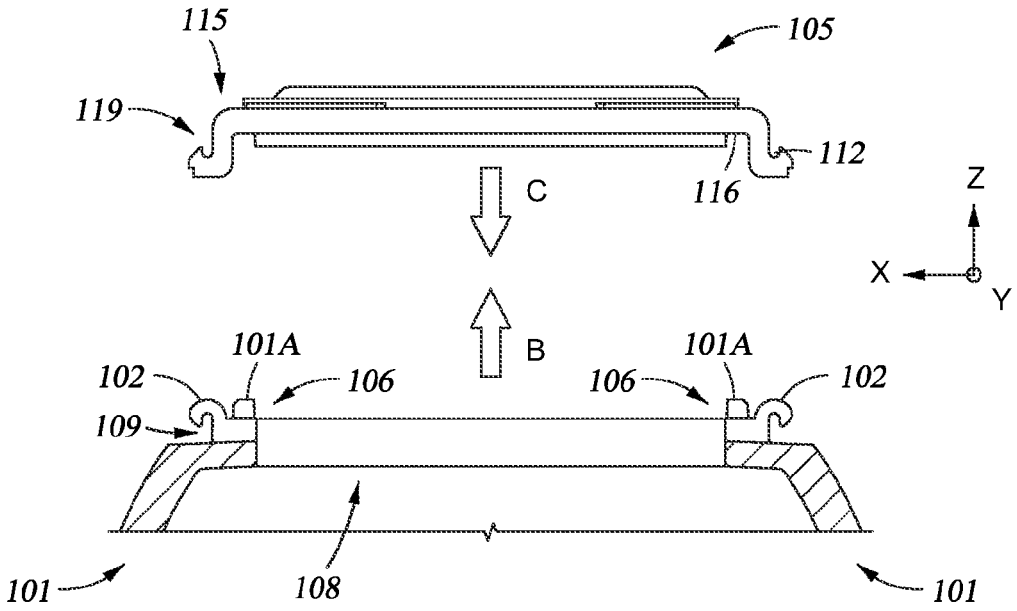
FIG. 3B is a partial side sectional view of a frame element and a housing to be included in the audio speaker of FIG. 3A.

FIG. 3B is an exploded side cross-sectional view that illustrates a portion of a frame element 115 and the housing 101. The housing 101 includes a first sealing surface 106 facing a second direction B (e.g., +Z-direction). The frame element 115 includes a second sealing surface 116 facing the first sealing surface 106 in a third direction C (e.g., −Z-direction). In some embodiments, when the frame element 115 is mounted to the housing 101, the first sealing surface 106 contacts the second sealing surface 116. As described above, one or more removable rods 130 can be used to compress the housing 101 and the frame element 115, which creates the seal between the first sealing surface 106 and the second sealing surface 116. In some embodiments, the seal between the first sealing surface 106 and the second sealing surface 116 is formed by use of a gasket 101A (e.g., elastomeric seal) that is disposed between the sealing surfaces 106, 116. In some configurations, a gasket 101A is positioned so that it forms a seal against the second sealing surface 116 that extends around the periphery of a frame element 115, 125, and is also configured to mate with the similarly shaped opposing first sealing surface 106 formed on the housing 101. Therefore, the housing 101 may include multiple different sealing surfaces 106 that are each sized to mate with each differently configured frame element 115, 125.

In some configurations of the housing 101, each housing retaining element 102 includes a housing channel region 109 (or hereafter groove 109), which in some cases may be U-shaped. In some configurations of the frame element 115, each frame retaining element 112 comprises a frame channel region 119 (or hereafter groove 119), which may be U-shaped. The removable rod 130 is inserted into the grooves 109, 119 to create the compression between the housing 101 and the frame element 115. In some embodiments, an external force is used to position the grooves 109, 119 to form a channel in which the removable rod 130 can be inserted. Although the grooves 109, 119 are described as U-shaped other designs may be used. For example, the grooves could be rotated approximately 90° as well as sized or shaped differently, so that the grooves are substantially C-shaped. Furthermore, in other embodiments one or more of the housing retaining elements 102 or frame retaining elements 112 may include a feature that completely surround the removable rod 130.

Figure 3C:
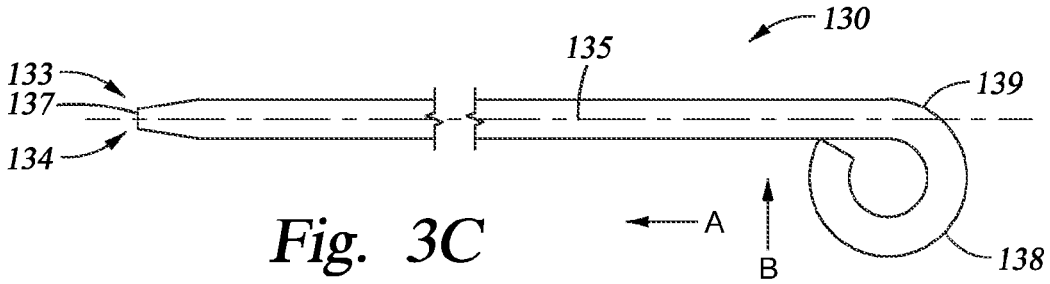
FIG. 3C is a side view of a removable rod to be used to secure one of the frame elements through the housing in the audio speaker of FIG. 3A.

FIG. 3C is a side view of a removable rod 130 that is used to secure one of the frame elements 115, 125 to the housing 101 in the audio speaker 100. The removable rod 130 can have a first axis 135 that extends along the length of the removable rod 130. The first axis 135 can be aligned in the first direction A when the removable rod 130 is inserted between arrays of housing retaining elements 102 and frame retaining elements 112 that are aligned in the first direction A. In some embodiments, the removable rod 130 can include a first end 137 that is tapered towards the first axis 135. Having an end that is tapered can ease the process of inserting the removable rod 130 between the housing retaining elements and the frame retaining elements. Furthermore, in some embodiments the removable rod 130 can include a handle 139 and a second end 138 of the removable rod 130. The handle 139 can take various forms, such as a loop, a bar extending perpendicular to the first axis 135, or any other shape that is at least somewhat wider than the removable rod 130 (i.e., in a direction perpendicular to the first axis 135). A handle 139 can ease the process of removing a removable rod 130 as well as reinserting a removable rod 130 between housing retaining elements 102 and frame retaining elements 112, 122. In some embodiments, a removable rod on one side of the audio speaker 100 may be connected to another removable rod on another side of the audio speaker, so that more than one removable rod can be removed simultaneously. For example, the two removable rods may be connected by a connecting bar disposed between the two removable rods, and thus the two removable rods can be removed from the audio speaker 100 by gripping and pulling on only one location on the connecting bar.

Figure 3D:
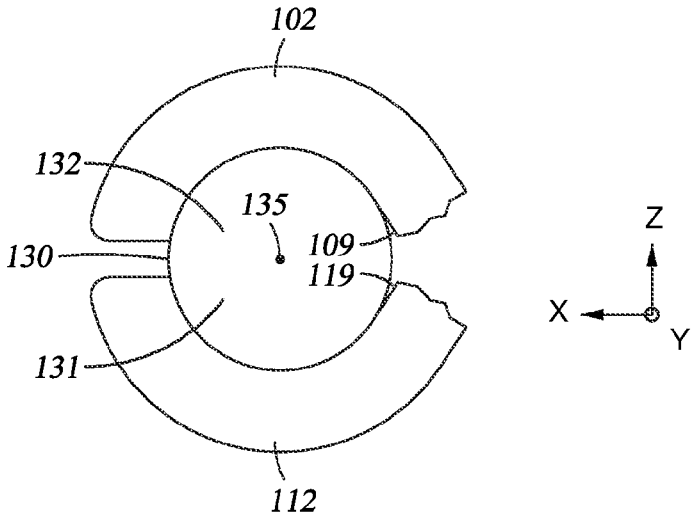
FIG. 3D is a side sectional view of a removable rod 130 between a housing retaining element and a frame retaining element.

FIG. 3D is a side sectional view of a removable rod 130 between a housing retaining element 102 and a frame retaining element 112. FIG. 3D may be taken from a perspective of the point 3D in FIG. 3A when viewed in the first direction "A", but the view would appear substantially the same at various points along the removable rod 130. The removable rod 130 includes a first region 131 on a first side 133 of the first axis 135. The removable rod 130 further includes a second region 132 on a second side 134 of the first axis 135. A direction from the first region 131 to the second region 132 is the second direction B (i.e., +Z-direction in FIGS. 3A-3B). Each housing retaining element 102 is disposed at least partially around portions of the second region 132. For example, a U-shaped groove 109 of the housing retaining element 102 can be disposed partially around portions of the second region 132 of the removable rod 130. Thus, each housing retaining element 102 is disposed at least partially around portions of the removable rod 130 to prevent movement of the removable rod 130 in the second direction "B" (i.e., +Z-direction in FIGS. 3A-3B) relative to the housing retaining elements 102. Each frame retaining element 112 is disposed at least partially around portions of the first region 131. For example, a U-shaped groove 119 of the frame retaining element 112 can be disposed partially around portions of the first region 131 of the removable rod 130. Thus, each frame retaining element 112 is disposed at least partially around portions of the removable rod 130 to prevent movement of the removable rod 130 in the third direction "C" (i.e., −Z-direction in FIGS. 3A-3B) relative to the frame retaining elements 112. In some embodiments, each housing retaining element 102 is disposed around the second region 132 and at least partially around the first region 131 and each frame retaining element 112 is disposed around the first region 131 and at least partially around the second region 132. In such embodiments, each housing retaining element and frame retaining element may be disposed around at least 50% of the circumference of the removable rod 130, where the circumference is measured around a cross-section that is perpendicular to the first direction "A." In some embodiments, at least a portion of the surface of the grooves 109 faces a direction that is opposite to a direction that at least a portion of the surface of the grooves 119 faces, when the second sealing surface 116 of the frame element 112 is disposed directly over the first sealing surface 106 of the housing 101.

In some embodiments, the grooves 109, 119 of each housing retaining element 102 and each frame retaining element 112 are in contact with a portion of the removable rod 130. Although the removable rod 130 is shown having a substantially circular cross-section, the removable rod can take on a variety of different shapes, such as a polygon-shaped cross-section. Furthermore, the cross-section of the removable rod can also be an asymmetrical shape. For example, in one embodiment an asymmetrical shaped cross-section for a removable rod may be rotated within grooves, such as grooves 109, 119, or rotated and then inserted into the grooves, so that the removable rod 130 can be easily inserted and the compression between the first sealing surface of the housing and the second sealing surface of the frame element can be adjusted by rotation of the removable rod 130.

Assembly Process Example

Figure 4A:
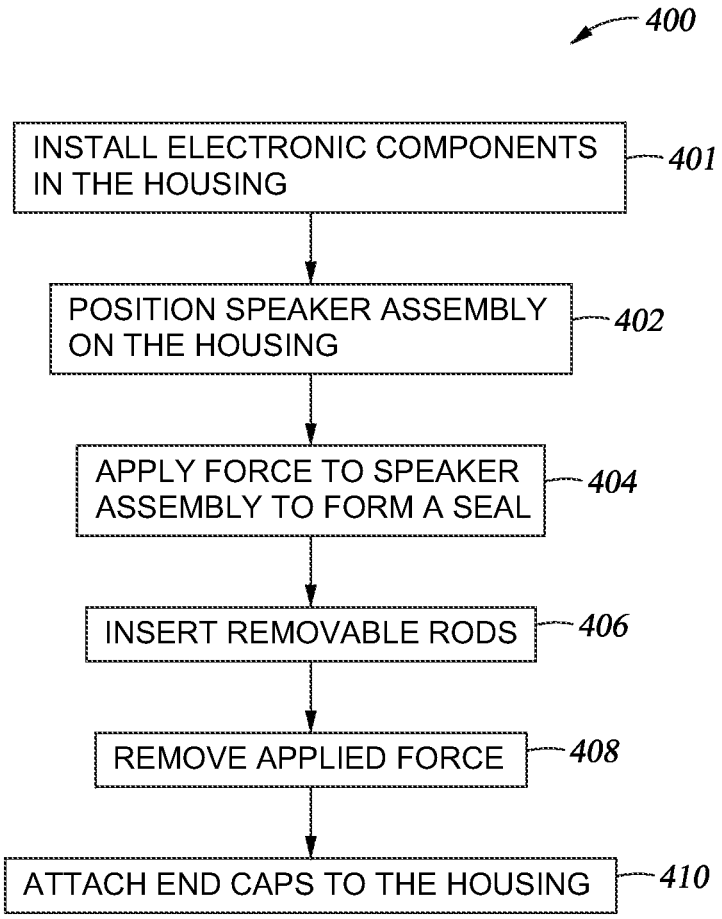
FIG. 4A is a flow diagram of method steps for installing one or more audio speaker assemblies onto a housing, according to an embodiment of the disclosure provided herein.
Figure 4B:
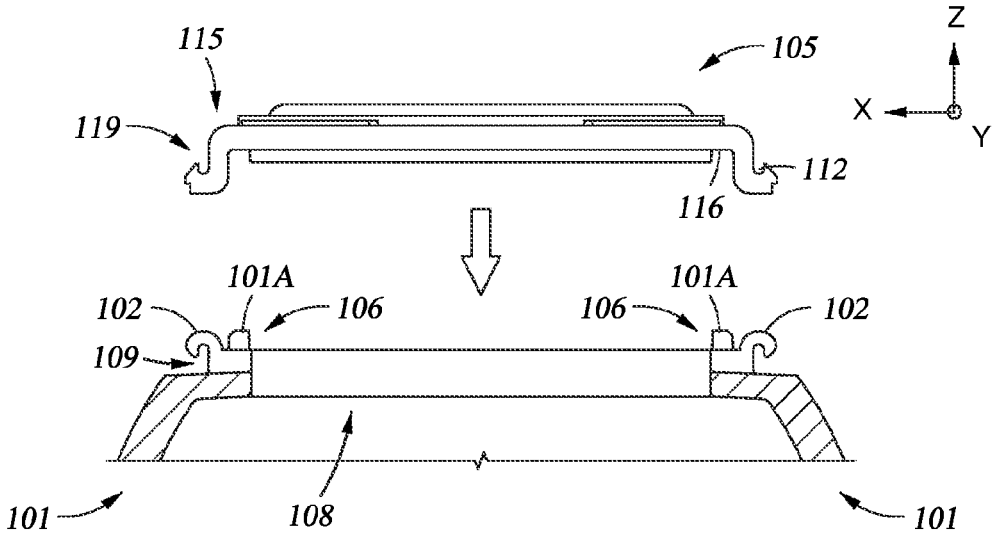
FIGS. 4B-4C are side cross-sectional views of a speaker assembly and a portion of a housing at different phases of the manufacturing process illustrated in FIG. 4A, according to an embodiment of the disclosure provided herein.
Figure 4C:
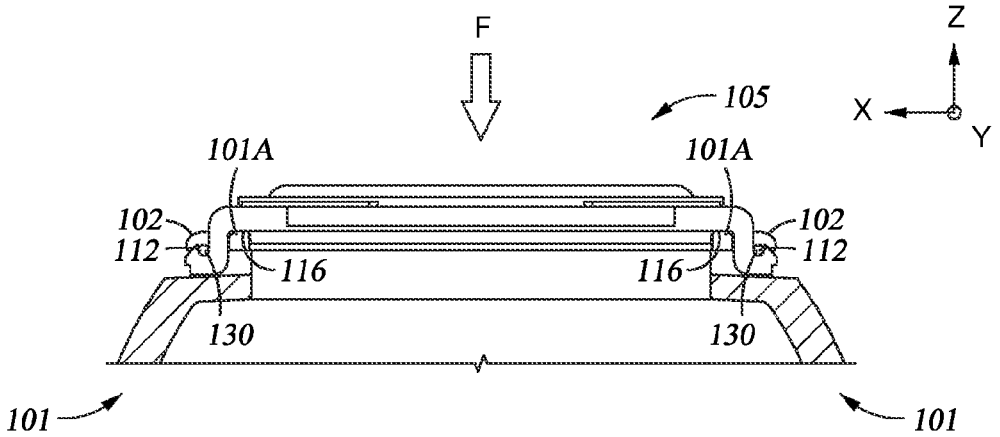

FIG. 4A is a flow diagram of method steps used to form part of the sealed audio speaker 100, according to an embodiment of the disclosure provided herein. FIGS. 4B and 4C are side cross-sectional views of a speaker assembly 105 and a portion of a housing 101 during different stages of the processing sequence described in FIG. 4A. Although the method steps are described in conjunction with the components illustrated in FIGS. 4A-4B, a person skilled in the art will understand that other configurations may be used to perform the method steps described herein.

The method 400 begins at step 401, where the electronic components 140 described above may be installed in the housing 101. The method 400 continues at step 402, where one or more frame elements, such as frame element 115, each having one or more attached speaker assemblies 105 are positioned on the housing 101, such that a portion of each speaker assembly 105 is positioned within an opening (e.g., speaker opening 108 (see FIGS. 2 and 4B)) formed within the housing 101. The frame retaining elements, such as frame retaining elements 112, are interleaved with housing retaining elements 102 when the one or more frame elements are positioned on the housing 101.

At step 404, optionally, a force F is applied to the one or more frame elements, such as frame element 115, to form a seal between the sealing surface 116 of each of the one or more frame elements and the sealing surface 106 of the housing 101. In some embodiments, the force F is applied to the frame material of the frame element that surrounds the attached speaker assembly 105. In other embodiments, a force F is applied to the speaker assembly 105 to compress the frame element and the housing. In some embodiments, the seal is formed by use of a gasket 101A (e.g., elastomeric seal) that is disposed between the sealing surfaces 106, 116. In other embodiments, the seal is formed by the deformation of the material found at the sealing surface 106 of the housing 101 and the sealing surface 116 of the frame element 115 due to the applied force, and thus does not require the use of a gasket material to form a seal.

Next, at step 406, a removable rod 130 is inserted into the space formed between the interleaved frame retaining elements, such as frame retaining elements 112, and the housing retaining elements 102 to lock the one or more frame elements, having attached speaker assemblies 105 disposed thereon, to the housing 101. As noted above, the audio speaker 100 may include at least two sets of interleaved arrays of retaining elements (e.g. a first set of arrays on the first side 151 and a second set of arrays on the second side 152 of the housing 101, see FIG. 3A) that are positioned to evenly spread the pressure supplied to the opposing sealing surfaces of the frame elements 115, 125 and the housing 101 when the removable rod 130 is inserted. For example, insertion of a first removable rod 130 can apply an equal and opposite sealing force on the first sealing surface 106 and the second sealing surface 116.

In configurations of the method 400 that do not require step 404 to be completed (i.e., no force F is applied to the one or more speaker assemblies 105), the insertion of the removable rods 130 during step 406 supplies the needed force to form a seal between the sealing surface 116 of each of the one or frame elements, such as frame element 115, and the sealing surface 106 of the housing 101. A removable rod having a tapered end can ease the process of inserting the removable rod when no force F is used to align and form a channel between the frame retaining elements with the housing retaining elements.

Next, at step 408, in configurations where a force F is applied during step 404, the force F is removed and the assembly of the speaker assembly 105 to the housing 101 is completed. Therefore, by positioning the removable rods 130 within a space or channel formed between the arrays of retaining elements (e.g., retaining elements 102 and 112) in step 406, the applied force between the frame element having the attached speaker assembly 105 and the housing 101 is retained so that the formed seal will remain after the force F is removed in step 408.

Next, at step 410, the end caps 150 are attached and mounted onto the housing 101 to enclose and form a sealed internal region 107. As noted above, in some embodiments, the end caps 150 can be retained against a gasket disposed on a sealing surface 145 of the housing 101 by use of mating mechanical clasping features formed in the housing 101 and end cap 150. In some configurations, an adhesive material may be used to generate a seal between the end cap 150 and the housing 101. In some configurations, the end cap 150 may be attached to the housing 101 using threaded connections on the end cap 150 and the housing 101.

Figure 5:
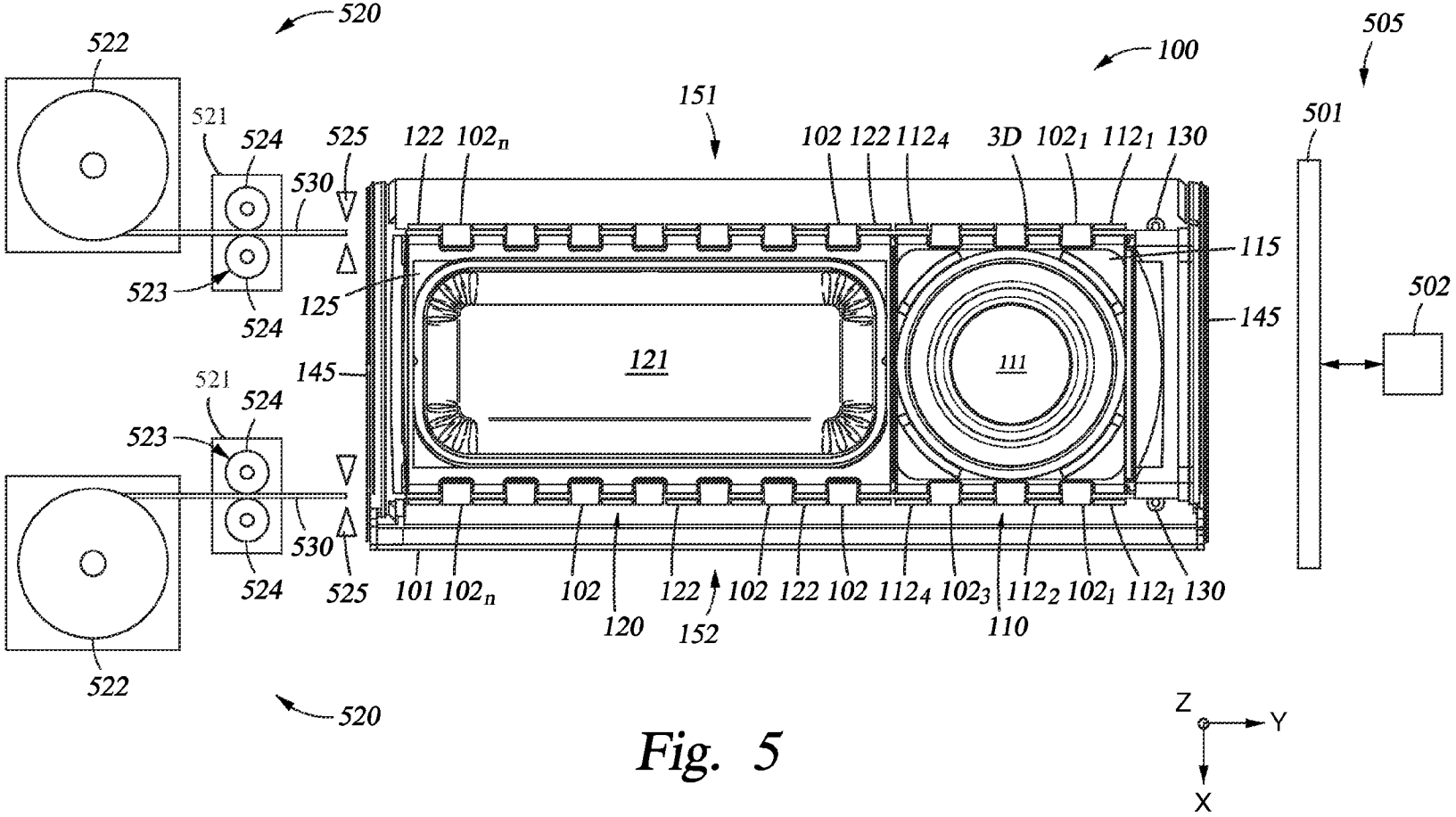
FIG. 5 is a plan view of automation devices used to assemble at least part of an audio speaker, according to an embodiment of the disclosure provided herein.

The method 400 is also well-suited for automation. Some features that may be used to automate the method 400 are illustrated in FIG. 5 and discussed below. The automation may begin with one or more robot end effectors (not shown) that may position the electronic components 140 in the housing 101 and place the one or more frame elements 115, 125 having the attached speaker assembly on the housing 101 to interleave the frame retaining elements with the housing retaining elements. Then, the housing 101 and the frame elements 115, 125 may be compressed, such as by using one or more movable members (not shown), such as one or more plates to evenly distribute the compression across the frame elements and the housing. In one embodiment, a hard stop (e.g., a substantially incompressible feature, such as a steel bolt or block) may be attached to the plate to prevent the application of too much force, or an uneven force, during compression between the frame elements and the housing. The hard stop could be disposed adjacent to the housing and substantially perpendicular to the plate during the compression. The hard stop may be configured to contact another substantially incompressible feature, such as a plastic or steel base. At this point, more than one set of arrays of interleaved housing retaining elements 102 and the frame retaining elements 112 may be properly aligned to have a channel ready to receive a removable rod 130.

Next, a removable rod 130 can be inserted into each channel between the interleaved housing retaining elements 102 and the frame retaining elements 112. In one embodiment, multiple spools of wire can be unwound and straightened to a predetermined length, such as the length of a channel between the housing retaining elements 102 and the frame retaining elements 112. Then, each straightened length of wire may be cut to form the different removable rods. In some embodiments, a tapered end and/or a handle can be formed at the ends of the removable rods. A tapered end may be formed, for example, by removing material from the removable rod. A handle may be formed, for example, by bending the wire to form a loop at one end of the removable rod. After the removable rods 130 are formed, each formed removable rod 130 may be simultaneously inserted into a channel formed between a set of housing retaining elements 102 and frame retaining elements 112 by use of a robotic actuator assembly 505. As illustrated in FIG. 5, the robotic actuator assembly 505 may include an end effector 501 that is actuated in the +Y and −Y directions by a loading device 502. During the removable rod insertion process step, the robotic actuator assembly 505 can be used to push all of the removable rods 130 into their respective channels formed between the housing retaining elements and frame retaining elements. In some embodiments, a user or machine may load multiple preformed rods into the robotic actuator assembly 505, which then pushes the rods into the channels formed between the housing retaining elements and the frame retaining elements.

Then, the compressive force applied between the housing 101 and the frame elements 115, 125 may be removed. Overall, automating the assembly of the audio speaker 100 using the removable rods and retaining elements described herein is simpler than assembling a speaker using conventional fasteners.

In another embodiment, an automated loading assembly 520 (FIG. 5) may be used to automatically insert removable rod material 530 (e.g., stainless steel wire) into the channel formed between the housing retaining elements 102 and frame retaining elements 112, and then cut the inserted removable rod material 530 to form a removable rod 130. In one configuration, an automated insertion device 521 is used to deliver the removable rod material 530 into the channels formed between the housing retaining elements 102 and the frame retaining elements 112 by use of an actuator 523. The actuator 523 may include a plurality of rollers 524 that are configured to remove a length of removable rod material 530 from a spool 522, and insert the removable rod material 530 into the channels formed between the housing retaining elements 102 and the frame retaining elements 112. A sectioning device 525 (e.g., wire cutters) may be used to cut the inserted removable rod material 530 to a desired length to form a removable rod 130. In some embodiments, multiple automated loading assemblies 520 are used to simultaneously insert removable rod material 530 into each of the channels formed between the housing retaining elements 102 and the frame retaining elements 112.

Furthermore, if during the manufacturing process it is desirable to remove the installed speaker assembly 105 from the housing 101, the user would only need to follow the steps shown in FIG. 4A in reverse. Manufacturing processes that use conventional speaker assembly mounting designs will often have one or more of the fastener mounting elements (e.g., threads) that become damaged, which can cause additional rework time or scrap of the damaged parts. Furthermore, removing numerous fasteners is more time-consuming than removing the removable rods disclosed herein.

However, by use of the configurations described herein the same housing 101 and speaker assembly 105 can be assembled, disassembled and then reassembled again with substantially less chance of damaging the various parts. The current design also removes the variability in the mounting force, and thus the mounting force is applied more evenly across the sealing surfaces since the amount of compression and/or strain is spread across the locations of the numerous retaining elements. Furthermore, the design of the components, such as the housing, frame elements, the retaining elements, and the removable rod largely control the pressure and forces on the components used for sealing the speaker, which removes problems in designs using fasteners, such as a person's ability to provide an equal torque to the fasteners.

One further advantage of the design disclosed herein is the space advantage gained by the use of the removable rods. For long sealing edges, like along the passive component, many screws (fasteners) would be needed. In one example, this would likely require 6, 8 or more screws per side of each passive component in a conventional design. Screws take up a significantly larger amount of space than the design(s) described herein, due at least to the need for the screw heads to clear the edge of the passive component. Therefore, the design(s) described herein enable a larger passive component (e.g., more surface area and excursion) to be used and a larger acoustic volume to be used in the same external package dimensions versus a design that uses fasteners, such as screws.

Furthermore, the features of the embodiments disclosed herein are not limited to being applied to audio speakers and may be applied to any electronic device that uses fasteners to mount components, connect structural features, or create seals. The features of the embodiments disclosed herein can also provide benefits for any electronic device that uses a sealed interior volume, such as a sealed housing.

While the foregoing is directed to embodiments of the present disclosure, other and further embodiments of the disclosure may be devised without departing from the basic scope thereof, and the scope thereof is determined by the claims that follow.

What is claimed is:

1. An audio speaker, comprising:

a housing having an internal region, a first array of housing retaining elements aligned in a first direction, and a first sealing surface, wherein each of the housing retaining elements have a housing channel region formed therein;

a frame element having a second array of frame retaining elements aligned in the first direction and a second sealing surface, wherein the second array of frame retaining elements are positioned to interleave with the first array of housing retaining elements when the second sealing surface is disposed over the first sealing surface, and each of the frame retaining elements have a frame channel region formed therein;

a first rod disposed within the housing channel regions of the first array of housing retaining elements and the frame channel regions of the second array of frame retaining elements;

an airtight seal formed between the frame element and the housing to seal the internal region of the housing when the first rod is disposed within the housing channel regions and the frame channel regions; and a speaker assembly mounted on the frame element.

2. The audio speaker of claim 1 wherein each housing channel region comprises a U-shaped groove that is partially disposed around the first rod.

3. The audio speaker of claim 1, further comprising:

a third array of housing retaining elements attached to the housing and aligned in the first direction;

a fourth array of frame retaining elements attached to the frame element and interleaved with the third array of housing retaining elements when the second sealing surface is disposed over the first sealing surface; and a second rod disposed between the third array of housing retaining elements and the fourth array of frame retaining elements.

4. The audio speaker of claim 1, wherein the first rod has a first end that is tapered towards a first axis that is parallel to the first direction.

5. The audio speaker of claim 4, wherein the first rod has a handle at a second end, the second end opposing the first end.

6. The audio speaker of claim 1, further comprising a gasket that is in contact with the first sealing surface and the second sealing surface when the first rod is disposed within the housing channel regions and the frame channel regions.

7. The audio speaker of claim 1, wherein the first array of housing retaining elements comprises at least three housing retaining elements and the second array of frame retaining elements comprises at least three frame retaining elements.

8. The audio speaker of claim 1, wherein the speaker assembly comprises an active speaker assembly or a passive element assembly.

9. The audio speaker of claim 1, further comprising a seal disposed in a first gap that is formed between the first sealing surface and the second sealing surface when the first rod is disposed within the housing channel regions and the frame channel regions, wherein a force is generated in the seal by the first sealing surface and the second sealing surface when the first rod is disposed within the housing channel regions and the frame channel regions.

10. The audio speaker of claim 1, wherein each frame channel region and each housing channel region are disposed around at least 50% of a circumference of the first rod, wherein the circumference is measured around a cross-section that is perpendicular to the first direction.

11. The audio speaker of claim 1, further comprising a seal formed between the first sealing surface and the second sealing surface when the first rod is disposed within the housing channel regions and the frame channel regions.

12. An audio speaker, comprising:

a housing having a first array of housing retaining elements aligned in a first direction, an internal region, and a first sealing surface, wherein each of the housing retaining elements have a housing channel region formed therein;

a first frame element having a first array of frame retaining elements aligned in the first direction and a second sealing surface, wherein the first array of frame retaining elements are positioned to interleave with the first array of housing retaining elements when the second sealing surface is disposed over the first sealing surface, and each of the frame retaining elements have a frame channel region formed therein;

a first rod disposed within the housing channel regions of the first array of housing retaining elements and the frame channel regions of the first array of frame retaining elements;

an airtight seal formed between the frame element and the housing to seal the internal region of the housing when the first rod is disposed within the housing channel regions and the frame channel regions;

an electronic assembly disposed in the internal region of the housing, wherein the electronic assembly comprises:

a processor;

a battery configured to deliver power to the processor; and a wireless transceiver configured to communicate with the processor; and an active speaker assembly mounted on the first frame element.

13. The audio speaker of claim 12, further comprising:

a third array of housing retaining elements attached to the housing and aligned in the first direction;

a fourth array of frame retaining elements attached frame and aligned in the first direction and interleaved with the third array of housing retaining elements; and a second rod disposed between the third array of housing retaining elements and the fourth array of frame retaining elements.

14. The audio speaker of claim 12, wherein the housing further comprises a third array of housing retaining elements aligned in the first direction and a third sealing surface, wherein each of the housing retaining elements in the third array have a housing channel region formed therein, and the audio speaker further comprises:

a passive element assembly mounted on a second frame element, wherein the second frame element has a fourth array of frame retaining elements aligned in the first direction and a fourth sealing surface, wherein the fourth array of frame retaining elements are positioned to interleave with the third array of housing retaining elements when the third sealing surface is disposed over the fourth sealing surface, and each of the frame retaining elements have a frame channel region formed therein, wherein the first rod is disposed within the housing channel regions of the third array of housing retaining elements and the frame channel regions of the fourth array of frame retaining elements.

15. A method of manufacturing an audio speaker, comprising:

positioning a first sealing surface of a first frame element over a second sealing surface of a housing, wherein a speaker assembly is mounted on the first frame element, the first frame element comprises an array of frame retaining elements that is aligned in a first direction, and the housing comprises an internal region and a first array of housing retaining elements that is aligned in the first direction; and inserting a first rod into a first channel region formed in the housing retaining elements and a second channel region formed in the frame retaining elements, wherein the first and second channel regions are aligned in the first direction, and an equal and opposite sealing force is formed on the first sealing surface and the second sealing surface when the first rod is disposed within the first and second channel regions, and an airtight seal is formed between the first frame element and the housing to seal the internal region of the housing when the first rod is disposed within the first and second channel regions.

16. The method of claim 15, further comprising applying a compressing force between the housing and the first frame element before inserting the first rod into the first channel.

17. The method of claim 16, further comprising removing the compression force after completing the insertion of the first rod into the first and second channel regions.

18. The method of claim 16, further comprising:

inserting the first rod into a third channel region formed in a third array of housing retaining elements that is aligned in the first direction and a fourth channel region formed in a fourth array of frame retaining elements in a second frame element, wherein the fourth array of frame retaining elements in the second frame element are aligned in the first direction, and an equal and opposite sealing force is formed on the second sealing surface and a third sealing surface of the second frame element when the first rod is disposed within the third and fourth channel regions.

19. An audio speaker, comprising:

a housing having a first array of housing retaining elements aligned in a first direction and a first sealing surface, wherein each of the housing retaining elements have a housing channel region formed therein;

a frame element having a second array of frame retaining elements aligned in the first direction and a second sealing surface, wherein the second array of frame retaining elements are positioned to interleave with the first array of housing retaining elements when the second sealing surface is disposed over the first sealing surface, and each of the frame retaining elements have a frame channel region formed therein;

a first rod disposed within the housing channel regions of the first array of housing retaining elements and the frame channel regions of the second array of frame retaining elements;

a third array of housing retaining elements attached to the housing and aligned in the first direction;

a fourth array of frame retaining elements attached to the frame element and interleaved with the third array of housing retaining elements when the second sealing surface is disposed over the first sealing surface;

a second rod disposed between the third array of housing retaining elements and the fourth array of frame retaining elements; and a speaker assembly mounted on the frame element.

* * * * *